US007611365B1

(12) United States Patent
Ng et al.

(10) Patent No.: US 7,611,365 B1
(45) Date of Patent: Nov. 3, 2009

(54) CONNECTOR

(75) Inventors: JenVun Ng, Westland, MI (US); Mark Grant, Whitelake, MI (US); Bryan D. Cole, Plymouth, MI (US); Vijay Keshavamurthy, Canton, MI (US); James Dawson, Macomb, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 12/353,037

(22) Filed: Jan. 13, 2009

(51) Int. Cl.
*H01R 13/62* (2006.01)

(52) U.S. Cl. ..... 439/157

(58) Field of Classification Search ..... 439/157–160
See application file for complete search history.

(56) References Cited

U.S. PATENT DOCUMENTS

| | | | | |
|---|---|---|---|---|
| 5,735,702 | A | 4/1998 | Hio | |
| 6,612,854 | B2 * | 9/2003 | Takata | 439/157 |
| 6,699,051 | B2 | 3/2004 | Hofmeister et al. | |
| 6,736,655 | B2 | 5/2004 | Martin et al. | |
| 6,739,889 | B1 * | 5/2004 | Daggett et al. | 439/157 |
| 6,848,925 | B2 * | 2/2005 | Nishide | 439/157 |
| 6,899,554 | B1 | 5/2005 | Osada | |
| 6,960,090 | B2 | 11/2005 | Denter et al. | |
| 6,997,725 | B2 | 2/2006 | Stella et al. | |
| 7,198,496 | B2 | 4/2007 | Yamamoto | |
| 7,361,036 | B2 | 4/2008 | Pittenger et al. | |
| 2007/0218729 | A1 | 9/2007 | Cheng et al. | |

* cited by examiner

*Primary Examiner*—Briggitte R Hammond
(74) *Attorney, Agent, or Firm*—Harness, Dickey & Pierce, P.L.C.

(57) ABSTRACT

A connector is provided. The connector can include a first housing, which can define a bore for receipt of at least one first electrical terminal. The first housing includes a first wall defining an aperture opposite a second wall. The connector can include a second housing, which can define a bore for receipt of at least one second electrical terminal. The second housing includes a first wall including a first engagement feature opposite a second wall. The connector includes a first rotatable element retained within the aperture of the first wall. The first rotatable element includes a first feature that engages the first engagement feature and a second feature. The connector can include a mechanical assist, which can include an assist feature. The assist feature can engage the second feature so that sliding movement of the mechanical assist draws the first electrical terminal into contact with the second electrical terminal.

20 Claims, 6 Drawing Sheets

CONNECTOR

INTRODUCTION

The present disclosure generally relates to an electrical wiring connector, and more particularly to a connector with reduced insertion forces.

Traditionally, electrical connectors can be used to couple, join or electrically connect various electrical components together to enable data, current, etc. to flow between the electrical components. For example, an electrical component can include one or more electrical wires, which can be joined together at a terminal. The terminal can be configured to mate with a corresponding terminal, in a male-female fashion. The electrical connector can facilitate the engagement of the male terminal with the female terminal, and the electrical connector can be configured to resist the disengagement of the female terminal with the male terminal.

Generally, in-line electrical connectors can be used in motor vehicles due to their compact size. A typical in-line connector can include a male housing that can surround a male terminal, and a female housing that can surround a female terminal. Typically, in order to engage the male housing with the female housing with this type of in-line connector, an operator has to use some force to push the female housing into the male housing, which can cause operator fatigue over time.

A connector is provided. The connector can include a first housing, which can define a bore for receipt of at least one first electrical terminal. The first housing can include a first wall opposite a second wall. The first wall can define an aperture, and the first housing can have a longitudinal axis. The connector can include a second housing, which can define a bore for receipt of at least one second electrical terminal. The bore can be sized such that the second housing can fit over a portion of the first housing. The second housing can include a first wall opposite a second wall. The first wall can include a first engagement feature. The connector can include a first rotatable element that can be coupled to the first housing and retained within the aperture of the first wall. The first rotatable element can include a first feature that engages the first engagement feature of the first wall of the second housing, and a second feature. The connector can include a mechanical assist, which can include at least one assist feature. The at least one assist feature can engage the second feature of the first rotatable element so that movement of the mechanical assist in a direction parallel to the longitudinal axis of the female housing can cause the first rotatable element to rotate and draw the at least one first electrical terminal into contact with the at least one second electrical terminal.

Further provided is a connector. The connector can include a female housing, which can define a bore for receipt of at least one female electrical terminal. The female housing can include a top wall opposite a bottom wall, and each of the top wall and the bottom wall can define an aperture. The connector can include a male housing, which can define a bore for receipt of at least one male electrical terminal. The bore can be sized such that the male housing can fit over a portion of the female housing. The male housing can include a top wall opposite a bottom wall, and each of the top wall and the bottom wall can include an engagement feature. The connector can include a first rotatable element, which can be rotatably coupled to the aperture of the top wall of the female housing. The first rotatable element can include a first feature that engages the engagement feature of the top wall of the male housing, and a second feature. The connector can include a second rotatable element, which can be rotatably coupled to the aperture of the bottom wall of the female housing. The second rotatable element can include a third feature that engages the engagement feature of the bottom wall of the male housing, and a fourth feature. The connector can include a mechanical assist, which can include a first assist feature. The first assist feature can engage the second feature of the first rotatable element. The mechanical assist can include a second assist feature, which can engage the fourth feature of the second rotatable element so that movement of the mechanical assist relative to the female housing can rotate the first rotatable element and the second rotatable element to draw the at least one female electrical terminal into contact with the at least one male electrical terminal.

In one of various embodiments, a connector is provided. The connector can include a female housing, which can define a bore for receipt of at least one female electrical terminal. The female housing can include a top wall opposite a bottom wall, a proximal end and a distal end. Each of the top wall and the bottom wall can define an aperture and can include a rail formed at the distal end. The connector can include a male housing, which can define a bore for receipt of at least one male electrical terminal. The bore can be sized such that the male housing can fit over a portion of the female housing. The male housing can include a top wall opposite a bottom wall, and each of the top wall and the bottom wall can include a projection. The connector can include a first rotatable element rotatably coupled to the aperture of the top wall of the female housing. The first rotatable element can include a top surface that extends beyond a surface of the female housing and can define a slot and a groove that slidably receives the projection of the top wall of the male housing. The first rotatable element can also include a bottom surface that retains the first rotatable element within the aperture. The connector can include a second rotatable element rotatably coupled to the aperture of the bottom wall of the female housing. The second rotatable element can include a top surface that extends beyond a surface of the female housing and defines a second slot and a second groove that slidably receives the projection of the bottom wall of the male housing. The second rotatable element can include a bottom surface that retains the second rotatable element within the aperture. The connector can include a mechanical assist, which can include a first pin that engages the slot of the first rotatable element, a second pin opposite the first pin that engages the second slot of the second rotatable element, a first guide that engages the rail of the top wall and a second guide that engages the rail of the bottom wall. The mechanical assist can be slidable on the rails of the female housing to draw the at least one female electrical terminal into contact with the at least one male electrical terminal.

Further areas of applicability of the present teachings will become apparent from the detailed description provided hereinafter. It should be understood that the description and specific examples, while indicating various embodiments of the present teachings, are intended for purposes of illustration only and are not intended to limit the scope of the present teachings.

BRIEF DESCRIPTION OF THE DRAWINGS

The present teachings will become more fully understood from the detailed description and the accompanying drawings, wherein.

DETAILED DESCRIPTION

The following description of various embodiments is merely exemplary in nature and is in no way intended to limit the present teachings. Although the following description is related generally to a connector, such as an in-line connector for use to releasably connect a male terminal with a female terminal, it will be understood that the connector, as described and claimed herein, can be used in combination with any appropriate system, component or device where it is desirable to secure two objects together with a mechanical assist, such as in coupling a plug-and-play device to a computing device. Therefore, it will be understood that the following discussions are not intended to limit the scope of the appended claims.

Figure 1:
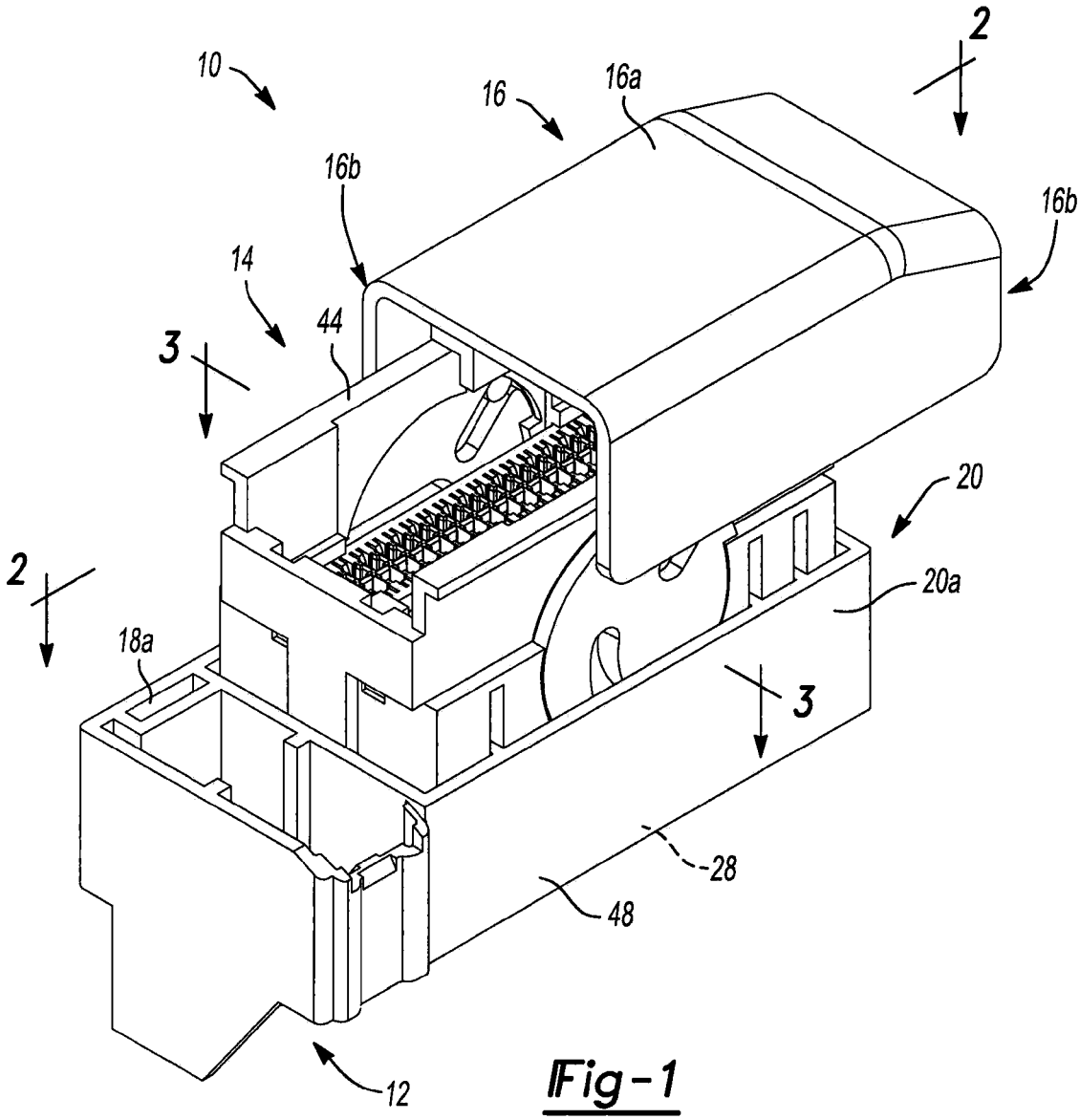
FIG. 1 is a perspective view of a connector according to various teachings.
Figure 2:
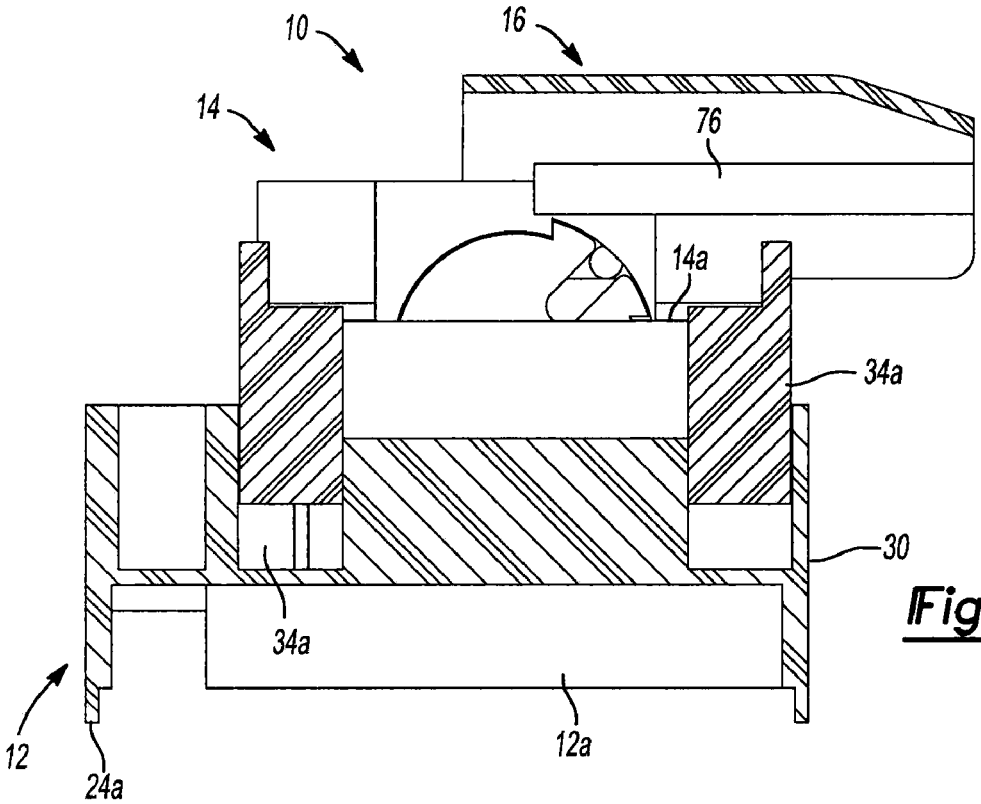
FIG. 2 is a cross-sectional view of the connector of FIG. 1, taken along line 2-2 of FIG. 1.

With reference to FIG. 1, an exemplary connector 10 is shown. The connector 10 can include a male housing 12, a female housing 14 and a female wire shield or mechanical assist 16. With additional reference to FIG. 2, the male housing 12 can enclose a set of male terminals 12*a*, and the female housing 14 can enclose a set of female terminals 14*a*. The male housing 12 can be releasably coupled to the female housing 14 via the mechanical assist 16 such that the set of female terminals 14*a* may be connected to the set of male terminals 12*a* using minimal force. By reducing the force necessary to couple the male housing 12 to the female housing 14, operator fatigue may be reduced over time. As the set of male terminals 12*a* and the set of female terminals 14*a* can comprise any desirable electrical terminals known in the art, the set of male terminals 12*a* and the set of female terminals 14*a* will not be discussed in great detail herein. Further, for the sake of clarity, the electrical wiring associated with each set of the male terminals 12*a* and the female terminals 14*a* has been simplified.

Figure 3:
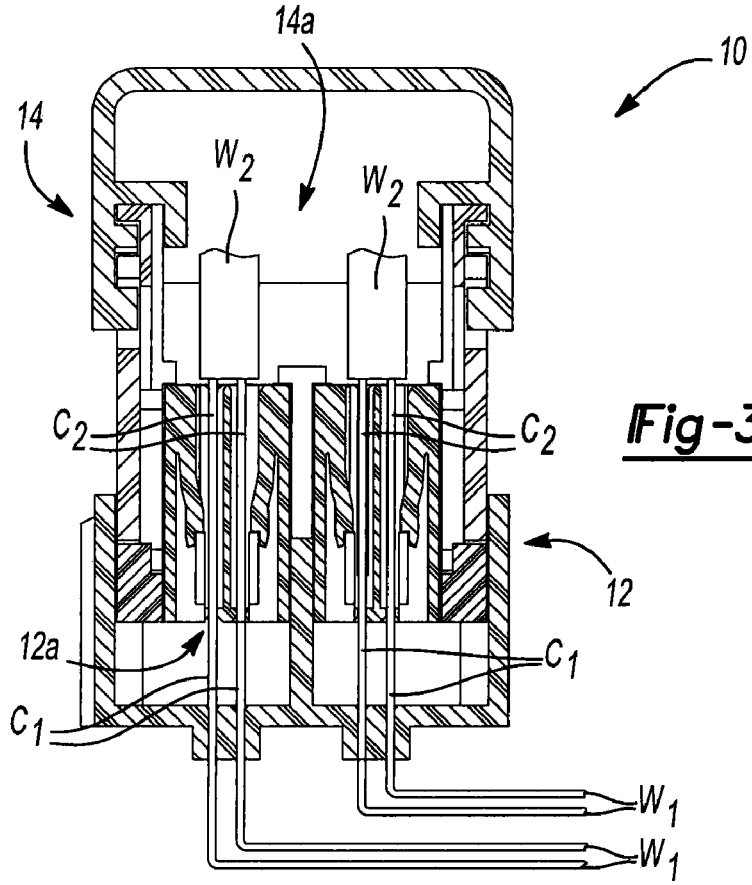
FIG. 3 is a cross-sectional view of the connector of FIG. 1, taken along line 3-3 of FIG. 1.

In this regard, with brief reference to FIG. 3. the set of male terminals 12*a* can include at least one wire $w_1$ and at least one contact $c_1$, while the set of female terminals 14*a* can include at least one wire $w_2$ and at least one contact $c_2$. When mated or engaged, the contacts $c_1$, $c_2$ can enable electrical communication over the wires $w_1$, $w_2$. Each of the male housing 12 and the female housing 14 can be composed of a suitable electrically insulative material, such as a polymer, and can be manufactured through any suitable technique, such as injection molding.

Figure 4:
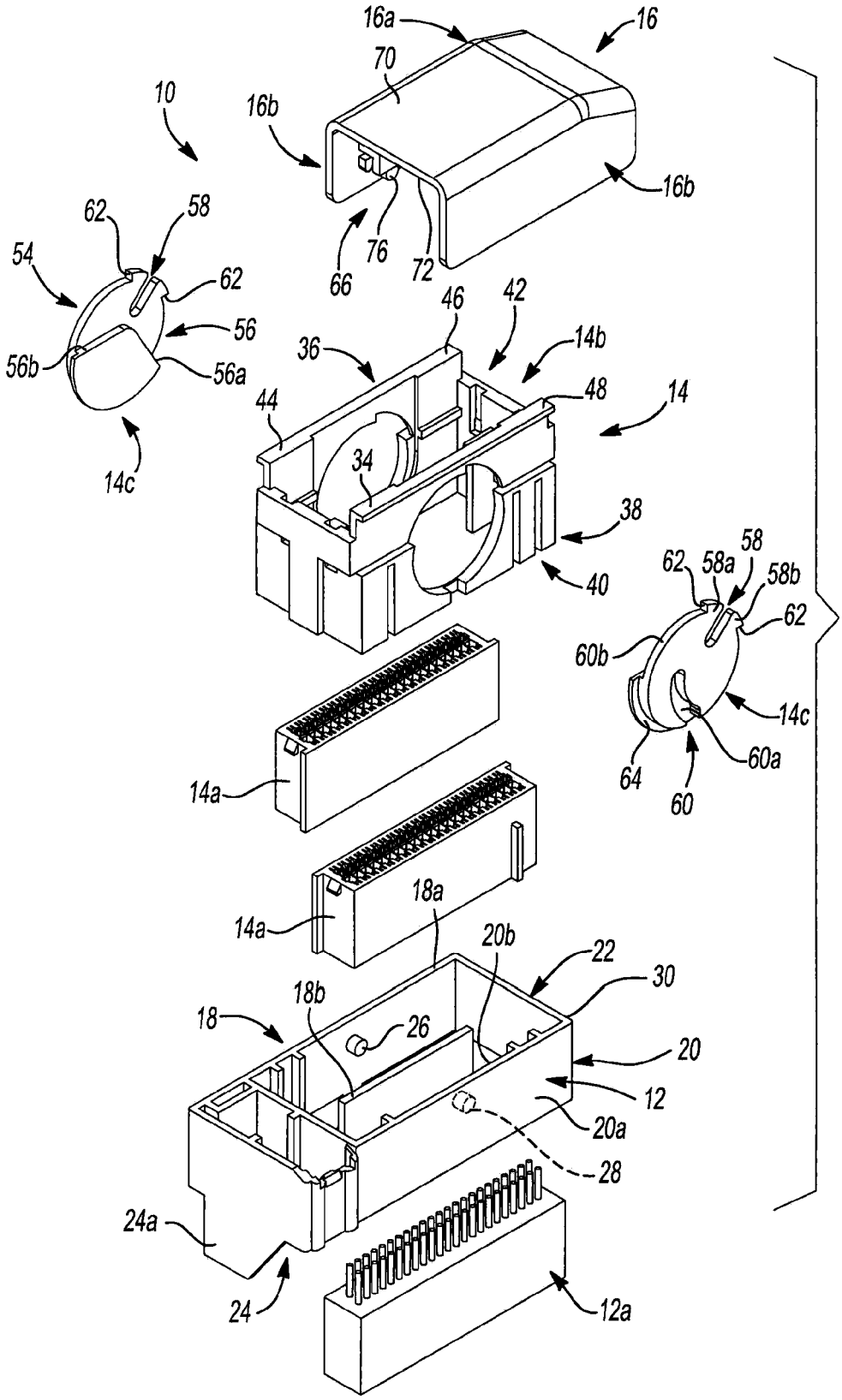
FIG. 4 is an exploded view of the connector of FIG. 1.

With reference to FIGS. 1 and 4, the male housing 12 can include a first or top wall 18, a second or bottom wall 20, a first or proximal end 22 and a second or distal end 24. The top wall 18 can include a first or outer surface 18*a* and a second or inner surface 18*b*. The outer surface 18*a* can be generally smooth, and the inner surface 18*b* can define a first engagement feature or first male projection 26. The first male projection 26 can cooperate with the mechanical assist 16 to couple the male housing 12 to the female housing 14, as will be discussed herein.

The bottom wall 20 can include a first or outer surface 20*a* and a second or inner surface 20*b*. The outer surface 20*a* can be generally smooth, and the inner surface 20*b* can define a second engagement feature or second male projection 28. The second male projection 28 can cooperate with the mechanical assist 16 to couple the male housing 12 to the female housing 14, as will be discussed herein.

The proximal end 22 can be configured to mate with the female housing 14, and can be generally rectangular in shape to define a bore 30. The bore 30 can receive a portion of the female housing 14, as will be discussed. The set of male terminals 12*a* can also be retained in a portion of the bore 30, such that the set of male terminals 12*a* can be positioned within the distal end 24, and contacts $c_1$ (FIG. 3) from the set of male terminals 12*a* can extend into the proximal end 22 as shown in FIG. 3. The distal end 24 can include one or more mounting features 24*a*, to assist in securing the male housing 12 to a structure in the motor vehicle.

With reference to FIGS. 1-5, the female housing 14 can mate with the male housing 12. With reference to FIG. 4, the female housing 14 can include a bracket 14*b* and one or more rotatable elements or rotators 14*c*. The bracket 14*b* can define a bore 34, a first or top wall 36, a second or bottom wall 38, a first or proximal end 40 and a second or distal end 42. The bore 34 can surround the set of female terminals 14*a*. In one example, with reference to FIG. 2, the bore 34 can include at least one divider 34*a* which isolates a first set of female terminals 14*a* from a second set of female terminals 14*a*. Although the female housing 14 is described and illustrated herein as including the first set of female terminals 14*a* and the second set of female terminals 14*a*, it should be understood that the female housing 14 can include any number of terminals, including one.

Figure 5:
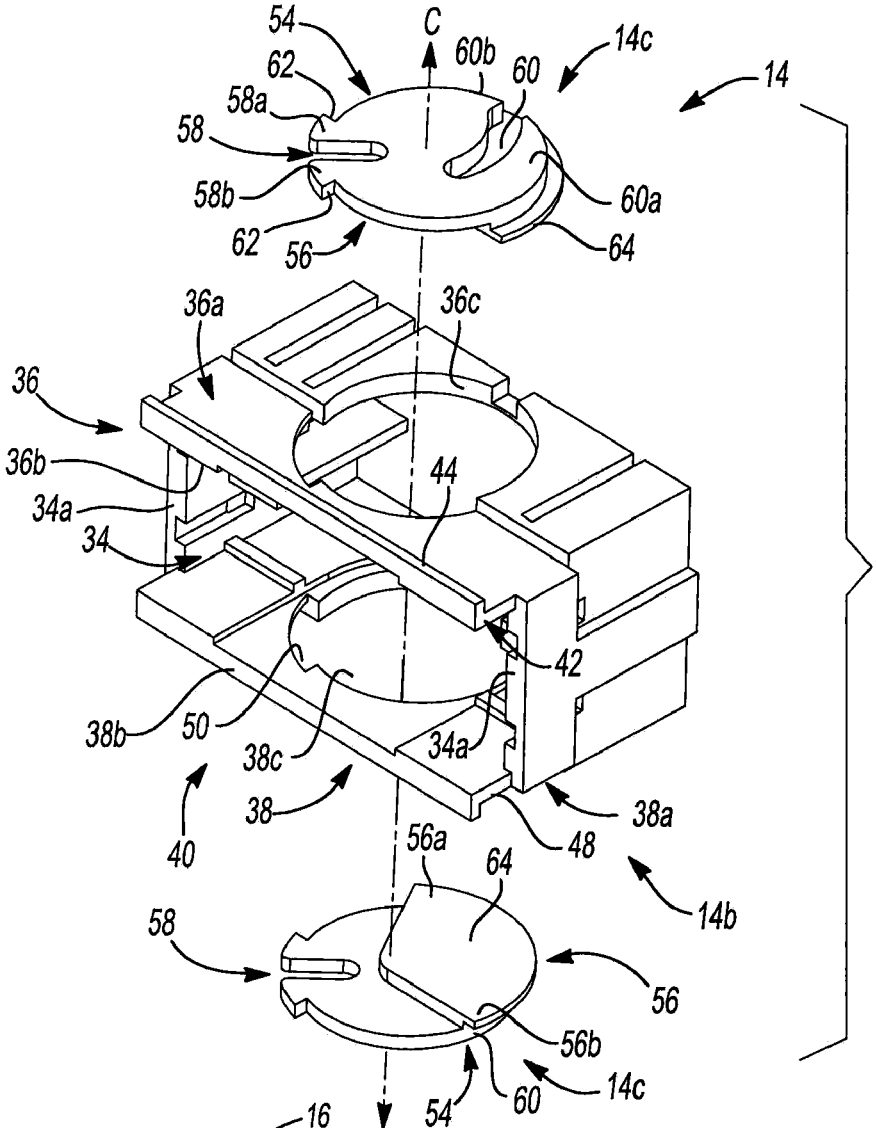
FIG. 5 is an exploded view of a female housing associated with the connector of FIG. 1.

With reference to FIG. 5, the top wall 36 can include a first or outer surface 36*a*, a second or inner surface 36*b* and an aperture 36*c*. The outer surface 36*a* can include a rail 44. The rail 44 can cooperate with the mechanical assist 16 to couple the male housing 12 to the female housing 14. Generally, the rail 44 can extend along a longitudinal axis of the outer surface 36*a*, adjacent to the distal end 42 of the female housing 14. As best shown in FIG. 4, the inner surface 36*b* can define a groove 46. The groove 46 can guide the rotation of a respective one of the rotators 14*c* within the aperture 36*c*, and thus, can enable the rotator 14*c* to move relative to the bracket 14*b* without the removal of the rotator 14*c* from the bracket 14*b*. With reference to FIG. 5, the aperture 36*c* can be formed generally about a central axis C of the bracket 14*b*. The aperture 36*c* can be sized to enable a respective one of the rotators 14*c* to move relative to the bracket 14*b*, upon receipt of an input from the mechanical assist 16, as will be discussed herein.

The bottom wall 38 can include a first or outer surface 38*a*, a second or inner surface 38*b* and an aperture 38*c*. The outer surface 38*a* can include a rail 48. The rail 48 can cooperate with the mechanical assist 16 to couple the male housing 12 to the female housing 14. Generally, the rail 48 can extend along a longitudinal axis of the outer surface 38*a*, adjacent to the distal end 42 of the female housing 14. The inner surface 38*b* can define a groove 50. The groove 50 can guide the rotation of a respective one of the rotators 14*c* within the aperture 38*c*, and thus, can enable the aperture 38*c* to move relative to the bracket 14*b* without the removal of the rotator 14*c* from the bracket 14*b*. The aperture 38*c* can be formed generally about the central axis C of the bracket 14*b*. The aperture 38*c* can be sized to enable a respective one of the rotators 14*c* to move relative to the bracket 14*b*, upon receipt of an input from the mechanical assist 16, as will be discussed herein.

The proximal end 40 can be configured to mate with the male housing 12, and can be sized to be received within the bore 30 of the male housing 12. Generally, the set of female terminals 14*a* can be positioned within the bracket 14*b* between the proximal end 40 and the distal end 42 such that the set of male terminals 12*a* can be inserted into the set of female terminals 14*a* to facilitate electrical communication between the set of male terminals 12*a* and the set of female terminals 14*a*. The distal end 42 can include the rails 44, 48, which can cooperate with the mechanical assist 16 to assist the operator in securing the male housing 12 to the female housing 14.

With reference to FIGS. 4 and 5, one rotator 14*c* can be received within each of the apertures 36*c*, 38*c* of the bracket 14*b*. The rotators 14*c* can cooperate with the mechanical assist 16 to couple the male housing 12 to the female housing 14. Each rotator 14*c* can be cylindrical, and can include a first or top surface 54 and a second or bottom surface 56. The top surface 54 can protrude from the respective apertures 36*c*, 38*c* of the bracket 14*b* to engage the mechanical assist 16. The top surface 54 can include a first feature or slot 58 and a second feature or groove 60. The slot 58 can extend from a distal end 58*a* at a circumference of the rotator 14*c* to a proximal end 58*b* near a center of the rotator 14*c*. The slot 58 can have a width sized to receive a portion of the mechanical assist 16, as will be discussed. The slot 58 can be bounded at the distal end 58*a* by flanges 62, which can extend outwardly from the circumference of the rotator 14*c*. The flanges 62 can guide the portion of the mechanical assist 16 into contact with the rotator 14*c*, and can maintain the contact between the mechanical assist 16 and the rotator 14*c*. The groove 60 can be generally arcuate, and can extend from a distal end 60*a* at the circumference of the rotator 14*c* to a proximal end 60*b* near the center of the rotator 14*c*. The groove 60 can be formed generally opposite the slot 58. The groove 60 can be sized to engage the male housing 12. In this regard, the groove 60 on one of the rotators 14*c* can slidably engage the first male projection 26, and the groove 60 on the other of the rotators 14*c* can slidably engage the second male projection 28. The engagement between the grooves 60 and the first and second male projections 26, 28 can cause the female housing 14 to move relative to the male housing 12 upon receipt of input from the mechanical assist 16, as will be discussed herein.

The bottom surface 56 can include a wedge 56*a*. The wedge 56*a* can have a thickness sized to enable a lip 64 formed along an edge 56*b* of the wedge 56*a* to slidably engage the groove 46, 50 of the inner surface 36*b*, 38*b* of the bracket 14*b*. Thus, the lip 64 can cooperate with the groove 46, 50 to retain the rotators 14*c* within the bracket 14*b*. Generally, the wedge 56*a* can be coupled to the bottom surface 56 at a location opposite the slot 58, and underneath the groove 60. Thus, the rotators 14*c* can be slidably retained within the bracket 14*b* and can move the female housing 14 relative to the male housing 12, via the mechanical assist 16.

Figure 6:
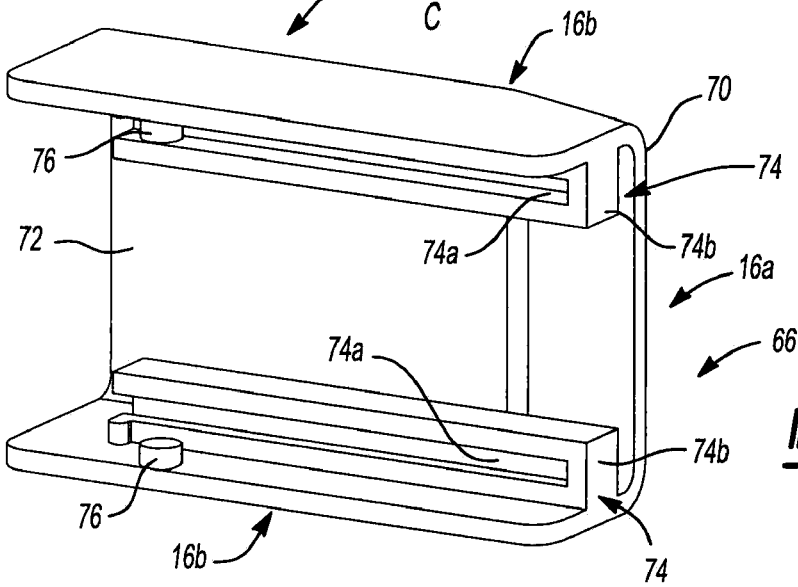
FIG. 6 is a perspective view of a mechanical assist associated with the connector of FIG. 1.

With reference to FIG. 1, the mechanical assist 16 can be slidably coupled to the rails 44, 48 of the bracket 14*b*. The mechanical assist 16 can be generally U-shaped, and can include a first or top wall 16*a* and one or more sidewalls 16*b*. With reference to FIGS. 4-6, the top wall 16*a* and sidewalls 16*b* can define a slot, generally indicated as 66, which can enable the mechanical assist 16 to move along the rails 44, 48 without interfering with the wires that extend from the distal end 42 of the female housing 14. Generally, the mechanical assist 16 can slide or move in a linear fashion along the rails 44, 48, in a direction parallel to the longitudinal axis of the female housing 14. Typically, with reference to FIGS. 7 and 8, the mechanical assist 16 can be moved from a first position (FIG. 7) adjacent to a sidewall 14*d* of the bracket 14*b* to a second position (FIG. 8) in which the mechanical assist 16 is disposed over the distal end 42 of the bracket 14*b* such that the mechanical assist 16 encloses the distal end 42 of the bracket 14*b*. Thus, when in the second position, the mechanical assist 16 can cover and thereby protect the wires of the female housing 14. As will be discussed, the movement of the mechanical assist 16 from the first position to the second position can rotate the rotators 14*c*, which can then cause the female housing 14 to move relative to the male housing 12 such that the set of female terminals 14*a* is electrically coupled to the set of male terminals 12*a*.

With reference to FIGS. 4-6, the top wall 16*a* of the mechanical assist 16 can include an outer surface 70 and an inner surface 72. The outer surface 70 can be generally smooth, but if desired, can include one or more features to facilitate operator use, such as ridges, projections, overmolded rubber, etc. The inner surface 72 can be generally smooth, but if desired, can include one or more features to assist in the routing of the wires associated with the female housing 14. If desired, the top wall 16*a* can include a taper to reduce the size of the mechanical assist 16.

The sidewalls 16*b* can be coupled to the top wall 16*a*. The sidewalls 16*b* can each include a guide 74 and an assist feature, such as a projection or pin 76. The guide 74 can extend outwardly from the sidewall 16*b*, and can define a slot 74*a*. The slot 74*a* can be sized to slidably receive the rails 44, 48 to enable the mechanical assist 16 to move along the rails 44, 48, relative to the bracket 14*b*. Generally, the slot 74*a* can include a stop 74*b*, which can prevent the further advancement of the mechanical assist 16 once the mechanical assist 16 is moved from the first position (FIG. 7) to the second position (FIG. 8).

With reference to FIGS. 4-6, the pin 76 can extend outwardly from the sidewalls 16*b* and can be sized to engage a respective one of the slots 58 of the rotators 14*c*. In this regard, the pin 76 associated with one of the sidewalls 16*b* can engage the slot 58 of one of the rotators 14*c*, and the pin 76 of the other sidewall 16*b* can engage the slot 58 of the other rotator 14*c*. The engagement of the pin 76 with the slot 58 can enable the mechanical assist 16 to rotate the rotators 14*c* as the mechanical assist 16 is moved from the first position (FIG. 7) to the second position (FIG. 8), and vice versa.

Figure 7:
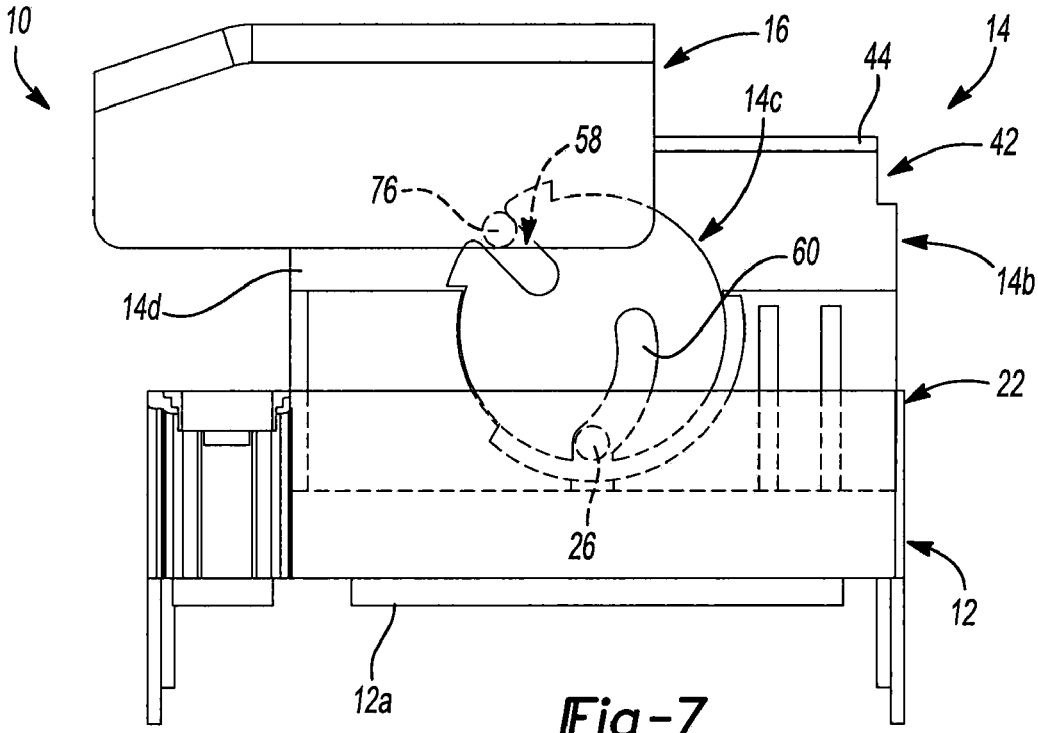
FIG. 7 is a top view of the connector of FIG. 1 illustrating the connector in a first position.
Figure 8:
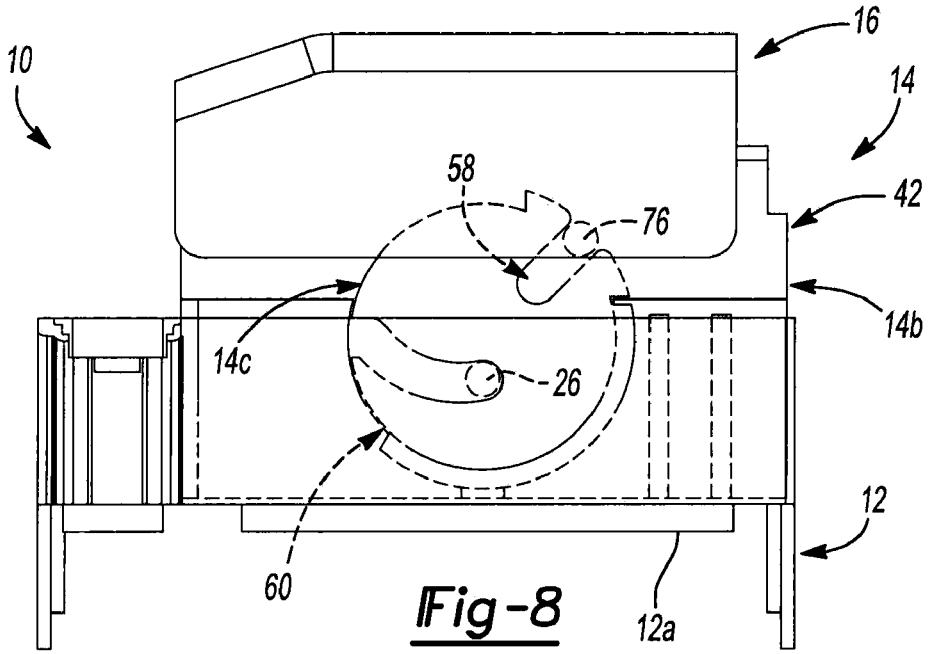
FIG. 8 is a top view of the connector of FIG. 1 illustrating the connector in a second position.

Thus, with reference to FIG. 7, in order to assemble the connector 10, the male housing 12 can be aligned with the female housing 14. In this regard, the proximal end 22 of the male housing 12 can be positioned adjacent to the bore 34 of the female housing 14, such that the first male projection 26 and second male projection 28 can be received within the grooves 60 of the rotators 14*c*. Generally, the proximal end 22 can be inserted with minimal force until the first male projection 26 and second male projection 28 are in contact with and within the grooves 60 of the rotators 14*c*.

Then, with the mechanical assist 16 in a pre-set position in which the pins 76 are engaged with the slot 58 of the rotators 14*c* and the guides 74 engaged with the rails 44, 48, the mechanical assist 16 can be moved by the operator in a direction parallel to the longitudinal axis of the bracket 14*b*, along the rails 44, 48. The movement of the mechanical assist 16 can rotate the rotators 14*c* within the apertures 36*c*, 38*c*, which can cause the first male projection 26 and second male projection 28 to move within the groove 60. Due to the arcuate shape of the groove 60, the movement of the first male projection 26 and second male projection 28 within the groove 60 can draw the set of female terminals 14*a* into electrical contact with the set of male terminals 12*a* as the mechanical assist 16 moves from the first position (FIG. 7) to the second position (FIG. 8).

In order to disengage the male housing 12 from the female housing 14, with reference to FIGS. 7 and 8, the operator can grip the mechanical assist 16, and can slide the mechanical assist 16 from the second position (FIG. 8) to the first position (FIG. 7). This movement can disconnect the set of male terminals 12*a* from the set of female terminals 14*a*, thereby allowing the female housing 14 to be removed with reduced force. It will be understood, however, that this disengagement procedure described herein is merely exemplary, and for example, if the female housing 14 is fixed on a support structure, disconnection can be accomplished by moving the male housing 12 out of female housing 14 or vice versa. Upon movement of the mechanical assist 16 from the second position (FIG. 8) to the first position (FIG. 7), the mechanical assist 16 can remain in the pre-set position to enable the re-engagement of the female housing 14 with the male housing 12. Thus, the connector 10 can enable the operator to engage and disengage the connector 10 easily, and with one-motion. This can enable the repeated installation of the connector 10 with minimal operator fatigue.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

Figure 9:
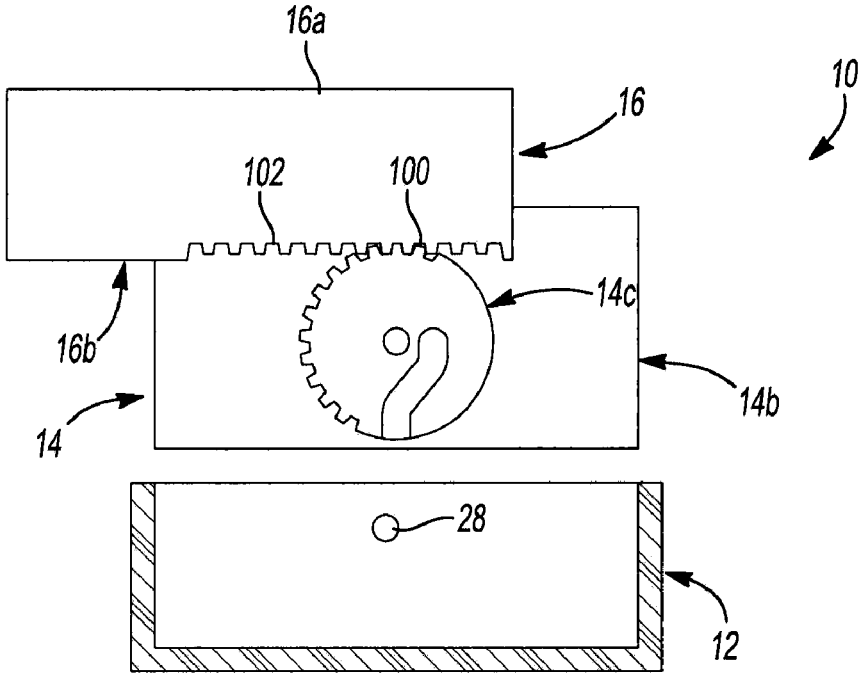
FIG. 9 is a schematic partially exploded illustration of the connector of FIG. 1 according to one of various embodiments.
Figure 10:
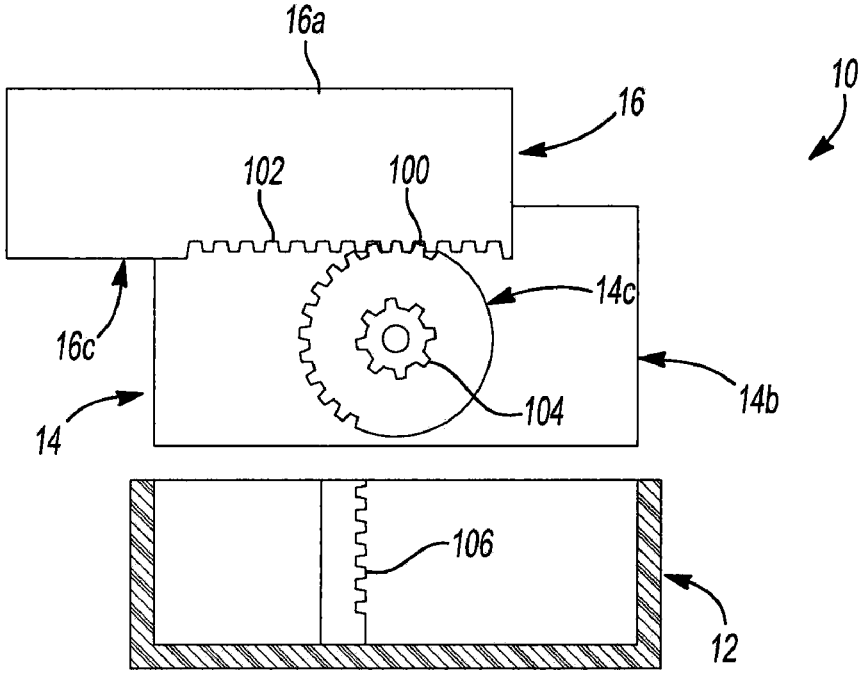
FIG. 10 is a schematic partially exploded illustration of the connector of FIG. 1 according to another of various embodiments.

For example, while the connector 10 has been described as including the rotator 14*c* that includes the slot 58 and the groove 60 to releasably secure a male terminal and female terminal connection, those of skill in the art will appreciate that the present disclosure, in its broadest aspects, may be constructed somewhat differently. For example, as shown in FIG. 9, the connector 10 could include rotators 14*c* that each include a pinion gear 100 formed in place of the slot 58, and the mechanical assist 16 could include a rack gear 102 formed on each of the sidewalls 16*b*. In this example, the movement of the mechanical assist 16 from the first position to the second position can rotate the pinion gear 100, which in turn can rotate the rotator 14*c* to draw the set of male terminals 12*a* into engagement with the set of female terminals 14*a*. In a further example, as shown in FIG. 10, the connector 10 could include rotators 14*c* that each include the pinion gear 100 formed in place of the slot 58 and a second pinion gear 104 formed in place of the groove 60. The mechanical assist 16 could include the rack gear 102 formed on each of the sidewall, and the male housing 12 could include a rack gear 106 formed on the top wall 18 and bottom wall 20 in place of the first male projection 26 and second male projection 28. In this example, the movement of the mechanical assist 16 from the first position to the second position can rotate the pinion gear 100, which in turn can rotate the second pinion gear 104 to draw the set of male terminals 12*a* into engagement with the set of female terminals 14*a*, via the rack gear 106.

What is claimed is:

1. A connector comprising:

a first housing that defines a bore for receipt of at least one first electrical terminal, the first housing including a first wall opposite a second wall, the first wall defining an aperture, the first housing having a longitudinal axis;

a second housing that defines a bore for receipt of at least one second electrical terminal, the bore sized such that the second housing fits over a portion of the first housing, including a first wall opposite a second wall, the first wall including a first engagement feature;

a first rotatable element coupled to the first housing and retained within the aperture of the first wall, the first rotatable element including a first feature that engages the first engagement feature of the first wall of the second housing, and a second feature; and a mechanical assist that includes at least one assist feature that engages the second feature of the first rotatable element so that movement of the mechanical assist in a direction parallel to the longitudinal axis of the female housing causes the first rotatable element to rotate and draw the at least one first electrical terminal into contact with the at least one second electrical terminal.

2. The connector of claim 1, wherein the second wall of the second housing includes a second engagement feature, the first engagement feature and second engagement feature selected from the group comprising: a projection, a rack gear or combinations thereof.

3. The connector of claim 1, wherein the mechanical assist includes a first assist feature opposite a second assist feature, the first assist feature and second assist feature selected from the group comprising: a pin, a rack gear or combinations thereof.

4. The connector of claim 3, further comprising:

a second rotatable element rotatably coupled to the aperture of the second wall of the first housing, the second rotatable element including a third feature that engages the second engagement feature of the second wall of the second housing, and a fourth feature that engages the second assist feature.

5. The connector of claim 4, wherein the first feature, second feature, third feature and fourth feature are selected from the group comprising: a groove, a slot, a pinion gear, or combinations thereof.

6. The connector of claim 3, wherein the first housing further includes a proximal end sized to be received within the second housing and a distal end, with each of the first wall and the second wall including a rail formed at the distal end that extends in a direction parallel to the longitudinal axis of the first housing.

7. The connector of claim 6, wherein the mechanical assist includes a first guide formed adjacent to the first assist feature that slidably engages the rail of the first wall and a second guide formed adjacent to the second assist feature that slidably engages the rail of the second wall.

8. The connector of claim 1, wherein the at least one first electrical terminal further comprises a first set of female electrical terminals separated from a second set of female electrical terminals by at least one divider positioned within the bore of the first housing.

9. A connector comprising:

a female housing that defines a bore for receipt of at least one female electrical terminal, the female housing including a top wall opposite a bottom wall, each of the top wall and the bottom wall defining an aperture;

a male housing that defines a bore for receipt of at least one male electrical terminal, the bore sized such that the male housing fits over a portion of the female housing, the male housing including a top wall opposite a bottom wall, each of the top wall and the bottom wall including an engagement feature;

a first rotatable element rotatably coupled to the aperture of the top wall of the female housing, the first rotatable element including a first feature that engages the engagement feature of the top wall of the male housing, and a second feature;

a second rotatable element rotatably coupled to the aperture of the bottom wall of the female housing, the second rotatable element including a third feature that engages the engagement feature of the bottom wall of the male housing, and a fourth feature; and a mechanical assist that includes a first assist feature that engages the second feature of the first rotatable element and a second assist feature that engages the fourth feature of the second rotatable element so that movement of the mechanical assist relative to the female housing rotates the first rotatable element and the second rotatable element to draw the at least one female electrical terminal into contact with the at least one male electrical terminal.

10. The connector of claim 9, wherein the engagement feature of the top wall and the engagement feature of the bottom wall of the male housing comprise an integral projection.

11. The connector of claim 10, wherein the first feature of the first rotatable element and the third feature of the second rotatable element comprise an arcuate groove that receives the projection of the top wall and the bottom wall of the male housing.

12. The connector of claim 9, wherein the first assist feature is formed on a first sidewall of the mechanical assist and the second assist feature is formed on a second sidewall of the mechanical assist, with the first sidewall opposite the second sidewall, and each of the first assist feature and second assist feature comprise an integral pin.

13. The connector of claim 12, wherein the second feature of the first rotatable element and the fourth feature of the second rotatable element each comprise a slot that receives a respective one of the integral pins of the mechanical assist.

14. The connector of claim 9, wherein the female housing further includes a proximal end sized to be received within the male housing and a distal end, with each of the top wall and the bottom wall including a rail formed at the distal end that extends in a direction parallel to the longitudinal axis of the female housing.

15. The connector of claim 14, wherein the mechanical assist includes a first guide formed adjacent to the first assist feature that slidably engages the rail of the top wall and a second guide formed adjacent to the second assist feature that slidably engages the rail of the bottom wall of the female housing to direct the movement of the mechanical assist in a direction parallel to the longitudinal axis of the female housing.

16. The connector of claim 9, wherein the at least one female electrical terminal further comprises a first set of female electrical terminals separated from a second set of female electrical terminals by at least one divider positioned within the bore of the female housing.

17. A connector comprising:

a female housing that defines a bore for receipt of at least one female electrical terminal, the female housing including a top wall opposite a bottom wall, a proximal end and a distal end, each of the top wall and the bottom wall defining an aperture and including a rail formed at the distal end;

a male housing that defines a bore for receipt of at least one male electrical terminal, the bore sized such that the male housing fits over a portion of the female housing, the male housing including a top wall opposite a bottom wall, each of the top wall and the bottom wall including a projection;

a first rotatable element rotatably coupled to the aperture of the top wall of the female housing, the first rotatable element including a top surface that extends beyond a surface of the female housing and defines a slot and a groove that slidably receives the projection of the top wall of the male housing and a bottom surface that retains the first rotatable element within the aperture;

a second rotatable element rotatably coupled to the aperture of the bottom wall of the female housing, the second rotatable element including a top surface that extends beyond a surface of the female housing and defines a second slot and a second groove that slidably receives the projection of the bottom wall of the male housing and a bottom surface that retains the second rotatable element within the aperture;

a mechanical assist that includes a first pin that engages the slot of the first rotatable element, a second pin opposite the first pin that engages the second slot of the second rotatable element, a first guide that engages the rail of the top wall and a second guide that engages the rail of the bottom wall; and wherein the mechanical assist is slidable on the rails of the female housing to draw the at least one female electrical terminal into contact with the at least one male electrical terminal.

18. The connector of claim 17, wherein the rails extend in a direction parallel to the longitudinal axis of the female housing.

19. The connector of claim 17, wherein the first guide is formed adjacent to the first pin on a first sidewall, and the second guide is formed adjacent to the second pin on a second sidewall that is opposite the first sidewall.

20. The connector of claim 17, wherein the at least one female electrical terminal further comprises a first set of female electrical terminals separated from a second set of female electrical terminals by at least one divider positioned within the bore of the female housing.

* * * * *